United States Patent [19]

Svoboda

[11] 4,302,028

[45] Nov. 24, 1981

[54] SAFETY SKI BINDING

[75] Inventor: Josef Svoboda, Schwechat, Austria

[73] Assignee: TMC Corporation, Baar, Switzerland

[21] Appl. No.: 72,878

[22] Filed: Sep. 6, 1979

[30] Foreign Application Priority Data

Sep. 8, 1978 [AT] Austria ..... 6489/78

[51] Int. Cl.[3] ..... A63C 9/18

[52] U.S. Cl. ..... 280/631; 280/636

[58] Field of Search ..... 280/623, 626, 628, 631, 280/632, 636, 605, 611

[56] References Cited

U.S. PATENT DOCUMENTS 3,545,781 12/1970 Salomon ..... 280/632
4,061,356 12/1977 Salomon ..... 280/605
4,103,929 8/1978 Beyl ..... 280/611

*Primary Examiner*—Joseph F. Peters, Jr.
*Assistant Examiner*—D. W. Underwood
*Attorney, Agent, or Firm*—Blanchard, Flynn, Thiel, Boutell & Tanis

[57] ABSTRACT

A pedal construction for effecting a closing of a heel safety ski binding in response to a stepping down thereonto by the heel portion of a ski boot. The pedal is pivotally secured to a base plate which is reciprocally mounted for movement between locked positions on the guide rail fixedly secured to the ski. The ski binding is mounted on the base plate and is movable therewith. The free end of the pedal remote from the pivot axle support therefor either slidingly engages a stepping spur on the ski binding or is pivotally connected to the stepping spur through a sliding-type connection.

10 Claims, 11 Drawing Figures

SAFETY SKI BINDING

FIELD OF THE INVENTION

The invention relates to a safety ski binding, which can be secured on a ski by means of a base plate and has for holding an inserted ski boot a hold-down means which is pivotal about an axis which extends substantially at a right angle with respect to the longitudinal axis of the ski, which hold-down means opens against the force of a spring during an overload and is provided, for a voluntary closing thereof with a stepping spur which can be stepped down upon by the ski boot.

BACKGROUND OF THE INVENTION

Ski bindings of the above-mentioned type are known in various embodiments and may therefore be identified as known for the average man skilled in the art. For special cases, it has also become known to hinge the stepping spur to the safety ski binding and to design its region which faces and operatively engages the ski boot with excessively large dimensions, as this is described for example in Austrian Pat. No. 292 521. This design is, however, intended for a ski binding with a rotary plate action. It is also provided with rings for receiving a long belt which additionally secures the ski boot on the binding and which is no longer common today.

Ski bindings are also known, which are equipped with a ski brake and have a special closing mechanism for operating the latter. For example, German OS No. 26 39 780 (corresponds to U.S. Pat. No. 4,135,728) is mentioned, in which a structural part which is identified as a pedal is arranged at the end of a brake or a stepping spur, which end faces the heel of the ski boot. Since the pedal is arranged freely rotatably in these designs, an unintended clamping may occur, in particular when such a pedal is used for closing a ski binding, and here also in the first place for closing without a ski boot as, for example, when transporting the skis. During the slightest amount of carelessness in operation, injuries, as for example pinching of the finger, may occur.

In a different known solution according to German OS No. 26 14 124 (corresponds to U.S. Pat. No. 4,061,356), a closing mechanism for a ski brake is described, which is hinged to a sole plate, wherein the sole plate is arranged between the ski-fixed ski binding parts and the ski boot is held on the sole plate in the region of the heel by means of a safety ski binding of the above-mentioned type. The stepping spur is thereby supported in a U-shaped pocket of the pedal which operates the ski brake. This solution is bound to the utilization of a special sole plate and thus cannot be easily transferred to bindings which are mounted directly on the upper surface of the ski.

Finally, German OS No. 14 78 182 (corresponds to U.S. Pat. No. 3,326,568) shows a ski binding, in which specially designed, hinged shoulders are provided, each of which cooperate with a stepping spur which is also arranged hingedly on the ski binding. This construction has the disadvantage that not only the shoulder, but also each stepping spur must be designed hingedly, whereby it does not matter that some embodiments are simpler, others in turn are more complicated in their structure.

As is known, ski bindings, in particular heel holders, are operated by stepping down on the stepping spur by means of the heel of the ski boot. Therefore, the perfect cooperation of boot heel and stepping spur is necessary for a secure closing of ski bindings. The underside of the heel is to define for this purpose with the rear side wall of the sole, viewed in a side view, approximately an angle of 90° or only slightly therebelow. Such ski boots, however, are less suited for walking, because they do not permit a rolling off. Therefore, a contrast exists with respect to the requirement as to comfort for walking and on the other hand the technical condition necessary to effect a perfect closing with the heel of the ski boot.

This is where the invention comes in which has the purpose of providing in a safety ski binding of the above-mentioned type a closing mechanism, which permits independent from the construction of the heel region of ski boots a perfect closing of the binding, without the closing member being able thereby to cause a jamming, or even injuries.

The set purpose is inventively attained by the one end area of a pedal being hinged to the base plate of the binding, the other end area of which is hinged longitudinally movable on the stepping spur or is arranged resting thereon.

All goals are achieved through the inventive measure. The heel of the ski boot closes the binding through a lever-joint system, which is closed in itself. Also an operation by hand can be carried out without a danger of injury and also without a jamming. The shape of the heel of the ski boot is without importance for the satisfactory closing of the binding. If desired, it is also possible to design already existing bindings in the inventive manner.

A particularly preferable embodiment of the invention consists in the pedal resting in the closed position of the binding in a recess of the base plate or being recessed into same. In this manner, the original elevational dimensions can be maintained, without requiring the hold-down means of the ski boot to be shifted vertically upwardly with respect to the upper side of the ski.

To connect the pedal with the stepping spur, it is provided, according to one thought of the invention, that the pedal has an approximately U-shaped design in the top view, the two legs of which are constructed in the region which is associated with the stepping spur as arms having slots therein, into which project an axle on the stepping spur which extends outwardly in direction of the two ski edges of the stepping spur, which are active as a sliding or holding axis, and that the two arms straddle, at least partially, around the remaining part of the stepping spur.

To connect the pedal and the stepping spur, it is provided, according to a different thought of the invention, that the pedal is biassed by a small springsteel plate which effects a swinging of the pedal in the same direction toward the base plate or toward the upper surface of the ski.

A further thought of the invention of such a construction inventively consists in particular for reasons of adjustment of existing stepping spurs of the pedal being constructed U- or T-shaped in the top view, wherein the two legs of the U or the stem of the T is associated with the stepping spur.

A further inventive measure favors the adjustment to existing space conditions. Same consist in the pedal having in the top view the form of a preferably equal-sided trapezoid.

If particularly high requirements are placed on the closing capability, a further inventive solution consists in the lower side of the pedal, which faces the stepping spur, being constructed to conform to the shape of the upper side of the stepping spur in the closed position of the binding.

BRIEF DESCRIPTION OF THE DRAWINGS

Further characteristics, advantages and details of the invention will be described in more detail with reference to the drawings illustrating several exemplary embodiments.

DETAILED DESCRIPTION

Figure 1:
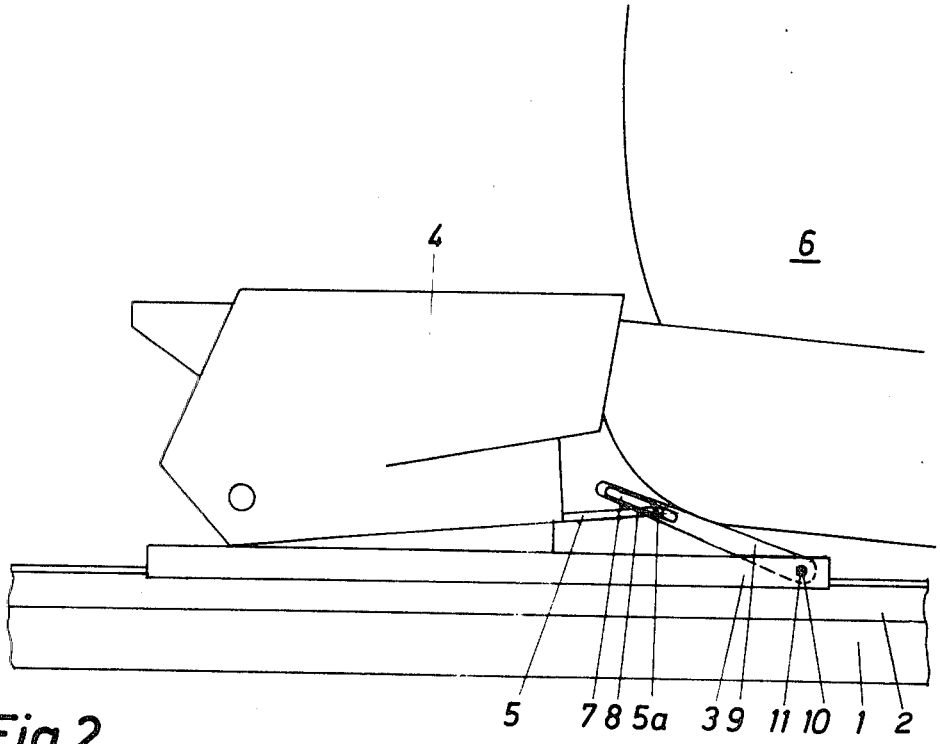
FIG. 1 is a side view of an inventive safety ski binding with a pedal.

An elongated guide rail 2 is fixedly mounted on a ski 1. A base plate 3 is arranged on said guide rail 2, which base plate can be moved back and forth in a direction parallel to the longitudinal axis of the ski between locked positions thereof. The base plate 3 has a safety ski binding 4 of the common type of construction mounted thereon and movable therewith. A stepping spur 5, which is arranged in a conventional manner on the safety ski binding 4, has in the top view an approximately T-shaped form. One exemplary type of safety ski binding, excluding the aforementioned shape of the stepping spur, is shown and described in U.S. Pat. Nos. 3,333,859; 3,351,354; 3,876,219 and 3,933,363 and are incorporated herein. The T-shaped form is achieved by the stepping spur 5 having at its end which faces the heel of a ski boot 6 a pair of coaxial axles 5*a* of a round or cylindrical cross section, which axles extend laterally toward the two ski edges and perpendicular to the longitudinal axis of the ski. The end of the stepping spur 5, which end is associated with the axles 5*a*, also has a rounded-off portion, the radius of which corresponds with the radius of the cylindrical axles 5.

Each of the two bearing axles 5*a* is received in a slot 7 provided on opposite lateral sides of the guide rail and in each of two arms 8 of a pedal 9, which arms extend rearward toward the safety ski binding 4. The pedal 9 is pivotally secured to the base plate 3 by an axle 11 located forwardly of the slots 7. Thus, the two coaxial axles 5*a* are active with reference to the pedal 9 as a common sliding or holding axle. The pedal 9 has in the top view an approximately U-shaped design of constant width and straddles with its two arms 8 the lateral sides of the stepping spur 5. The bearing axle 11 is arranged in the base plate 3 so that the pedal 9 is received in a rectangular-shaped recess 12 in the base plate 3 defined by the spacing between the arms 8 and bight portion 8A thereof. The end of the pedal 9 rearwardly from bight portion 8A has, as is visible from the illustration of FIG. 1, a pair of axially aligned openings 10 therein, the axis of which extends approximately perpendicular with respect to the longitudinal axis of the ski. The pedal 9 is as stated above swingably supported on the bearing axle 11 received in the opening 10. The bight portion 8A of the pedal 9 rests on the forward end of the recess 12, which end is remote from the safety ski binding 4.

If one now steps with a ski boot, the sole of which, as can be seen from the drawing according to FIG. 1, has a rounded-off portion in the region of the heel, into the safety ski binding 4, the sole of the ski boot 6 will engage the pedal 9 to effect a pivoting thereof in a direction toward the upper surface of the ski 1. The stepping spur 5 is thereby operated on through the arms 8 to cause the safety ski binding 4 to be closed. A tilting of the pedal 9 away from the safety ski binding 4 and opposite to the closing direction, if a ski boot 6 is not clamped between the toe and heel bindings, is prevented by the guideway formed by the two slots 7 and the two arms 8.

Figure 2:
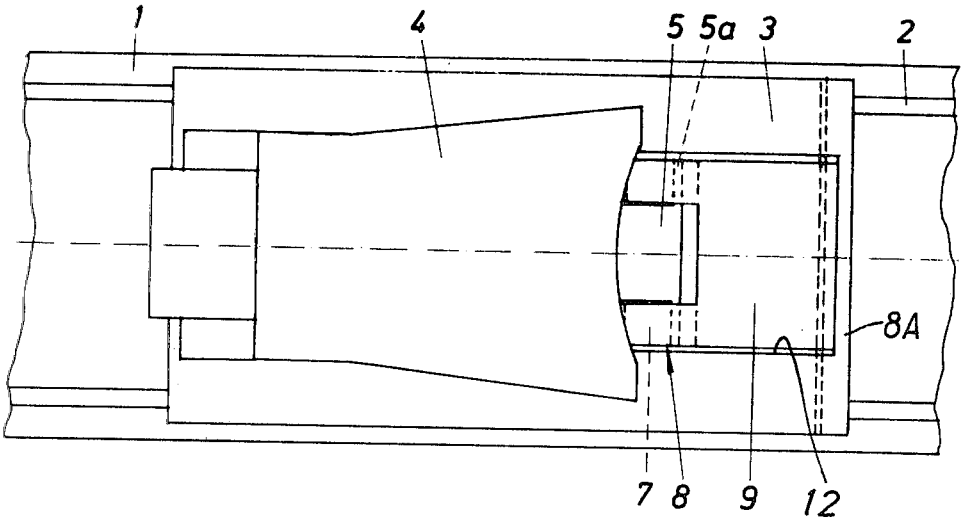
FIG. 2 is a top view of FIG. 1 without the ski boot.
Figure 3:
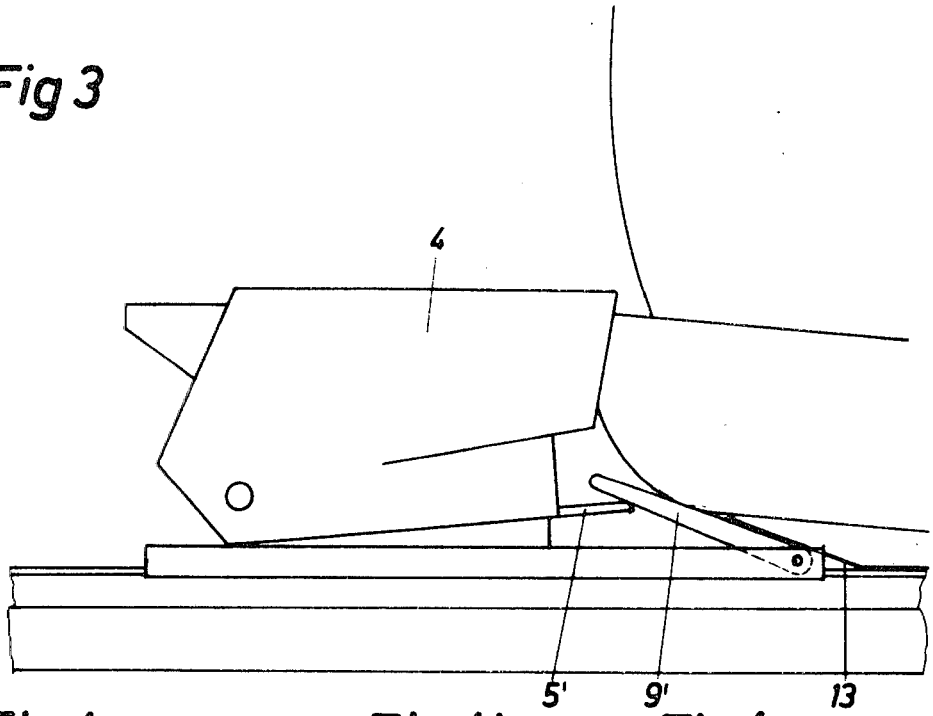
FIG. 3 illustrates a different exemplary embodiment similar to FIG. 1, also in a side view.

The exemplary embodiment according to FIG. 3 is substantially similar to the one illustrated in FIGS. 1 and 2. There exist differences with respect to the structure in that the pedal 9' does not have any slots at all and also the stepping spur 5' is not provided with guide arms or coaxial axles. We deal in the case of the stepping spur 5' and the safety ski binding 4 with a known construction. However, and in order to, in spite of this, prevent a tilting away of the pedal 9' from the stepping spur 5' when the ski boot is not inserted, a small spring-steel plate 13 is provided which biasses the pedal 9' toward the upper surface of the ski. If the safety ski binding is opened automatically or arbitrarily, only the small force of the small spring-steel plate 13, which force can thus be neglected with respect to the functioning of the ski binding, opposes the force of the strong opening spring in the safety ski binding. As a result, the pedal 9' can be used easily as an additional device practically for each common safety ski binding 4 of this type. The pedals 9' to $9^{V}$ which are illustrated in FIGS. 4*a* to 4*e* illustrate some exemplary embodiments for pedals, which can be used advantageously in common safety ski bindings. The pedals 9' to $9^{V}$ have the same shape in the side view; only their outline in the top views, as illustrated, differentiates them from one another.

Figure 4A:
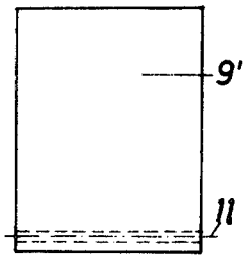
FIGS. 4*a* to 4*e* illustrate top views of various embodiments of the pedal.
Figure 4B:
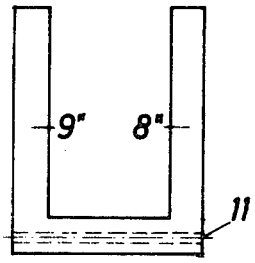
Figure 4C:
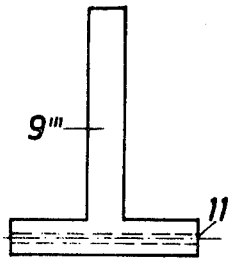
Figure 4D:
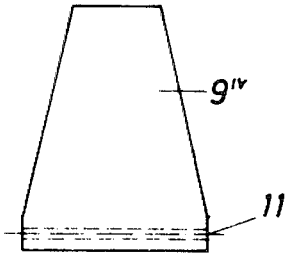
Figure 4E:
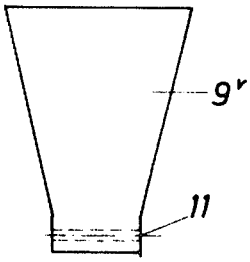

The pedal 9' which is illustrated in FIG. 4*a* represents an embodiment which is the most simple one which can be used practically for all stepping spurs and without consideration of individual specialties. For other types of binding arrangements, the embodiments according to FIGS. 4*b* and 4*c* are provided. The pedal 9'' can be used for the operation of a stepping spur having two laterally spaced receiving points, the pedal 9''' according to FIG. 4*c*, however, being utilizable for a stepping spur having a narrow center area. The pedal $9^{IV}$ according to FIG. 4*d* and the pedal $9^{V}$ according to FIG. 4*e* are considered particularly for those cases wherein due to existing conditions, special external dimensions must be considered. The pedal $9^{IV}$ according to FIG. 4*d* can thereby, similar to the embodiment of the pedal 9''' according to FIG. 4*c*, be used advantageously in connection with a stepping spur having a narrow receiving point. Particularly when an extremely exact closing capability of the stepping spur is demanded from the pedal, said stepping spur can have on the underside thereof a conforming construction (not shown) which corresponds with the upper side of the stepping spur. Such a construction should be easily possible without any further explanations for the man skilled in the art. In this connection, it is furthermore important for the invention that one of the conforming regions consists of an elastic rubber material or is provided with a coating of such a material.

Only to be complete it is mentioned that the geometric shapes of the pedals 9' to $9^{V}$ are in the sequence a rectangle, a U-, a T- and two equal-sided trapezoids. Even if for technical manufacturing reasons the use of an equal-sided trapezoid is more advantageous, it can, if desired, be advantageous to use a nonequal-sided trapezoidal form. The construction of the pedal $9^{IV}$ according to FIG. 4*d* can moreover also be used advantageously and inventively in connection with a stepping spur according to FIGS. 1 and 2.

Figure 1A:
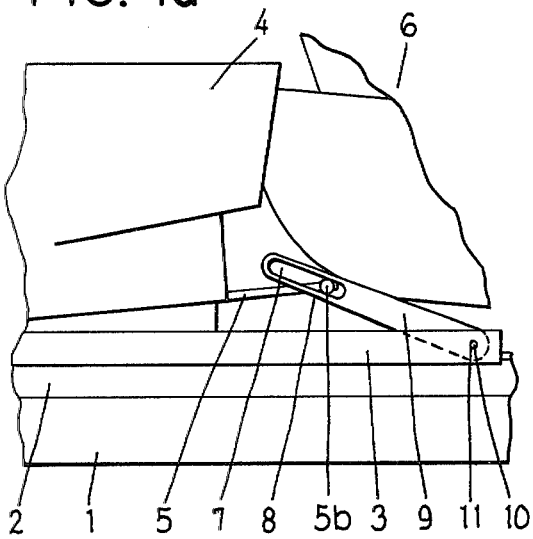
FIGS. 1*a* and 1*b* each illustrate an alternative embodiment of the ski binding of FIG. 1.
Figure 1B:
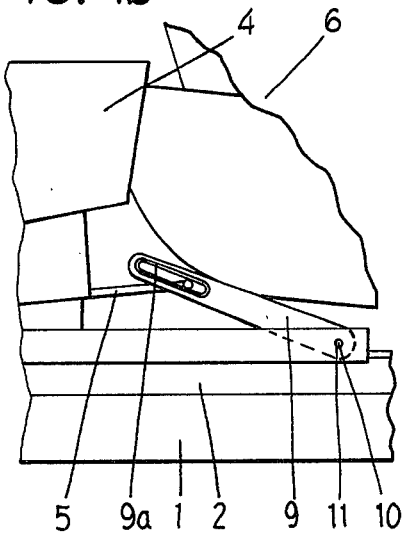
Figure 1C:
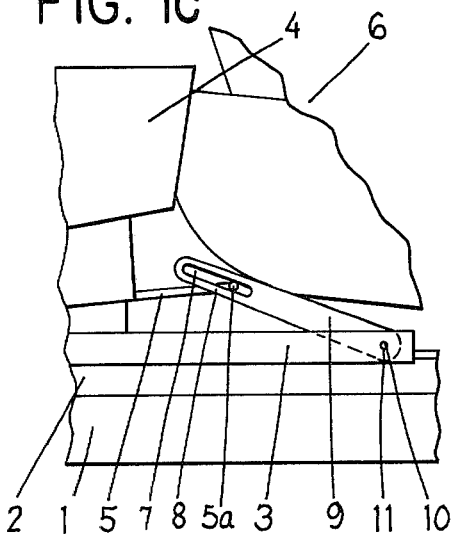
FIG. 1*c* is an enlarged view of a portion of FIG. 1 illustrating details thereof.

The invention is not limited to the illustrated exemplary embodiments. Further modifications can be made without departing from the scope of the invention. For example, the pedal can be used simultaneously for effecting a swinging of a ski brake from the braking position into the retracted position or one can, as this is actually known, associate the operation of the ski brake with the stepping spur. To reduce the frictional forces, it is possible to arrange a roller between the pedal and the stepping spur, as this is also known, for example at 5*b* in FIG. 1*a*, or one can manufacture at least one of the surfaces of the pedal and the stepping spur so that they can be moved relative to one another and of a material which has a low friction coefficient or by providing same with a layer of such a material. As an acceptable material, for example at 9*a* in FIG. 1*b* one can use for example polytetrafluoroethylene, which is known under the trade name Teflon.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a safety ski binding having a base plate which can be fastened on a ski, hold-down means for holding a ski boot, said hold-down means having a stepping spur and can be swung about an axis which extends substantially at a right angle with respect to the longitudinal axis of the ski between an open position and a closed position holding said ski boot, said hold-down means moving to said open position when sufficient forces are exerted by said ski boot on said ski binding and said stepping spur facilitating movement of said hold-down means to said closed position when stepped down upon by said ski boot, the improvement comprising a U-shaped pedal having a bight portion which is hingedly connected to said base plate and having two legs which straddle said stepping spur, each said leg having a slot therein and including axles which extend outwardly in the direction of the ski edges from opposite sides of said stepping spur, each said axle being slidably received in a respective said slot.

2. The safety ski binding according to claim 1, including an upwardly facing recess in said base plate in which said pedal is received in said closed position of said hold-down means.

3. The safety ski binding according to claim 1 or 2, including a spring-steel element which engages said pedal and said base plate, wherein said pedal is biassed by said springsteel element in a direction toward said base plate and toward the upper side of said ski.

4. The safety ski binding according to claim 1, wherein at least one of the surfaces of said pedal and said stepping spur which contact each other consists of polytetrafluoroethylene.

5. The safety ski binding according to claim 1, including roller means cooperable with said pedal and said stepping spur for reducing friction therebetween.

6. A safety ski binding, comprising:

a base plate adapted to be mounted on a ski;

hold-down means mounted on said base plate for holding a ski boot, said hold-down means having a stepping spur fixedly located thereon and can be swung about a first axis which extends substantially at a right angle with respect to the longitudinal axis of the ski between an open position and a closed position holding said ski boot, said hold-down means moving to said open position when sufficient forces are exerted by said ski boot on said ski binding and said stepping spur facilitating movement of said hold-down means to said closed position when stepped down upon by said ski boot; and elongated pedal means pivotally secured at one end thereof to said base plate about a second axis parallel to said first axis, said second axis being located forwardly of said ski binding and stepping spur and beneath the sole of said ski boot when said ski boot is held thereby in said closed position thereof, the other end of said elongated pedal means projecting rearwardly toward and slidably engaging an upwardly facing part of said stepping spur fixedly secured to said hold-down means so that a stepping down upon said pedal means by said ski boot will effect a simultaneous moving of said hold-down means to said closed position independent of the construction of the sole of said ski boot.

7. The safety ski binding according to claim 6, wherein said pedal means is constructed T-shaped in the top view, wherein the stem of the T slidably engages said stepping spur.

8. The safety ski binding according to claim 6, wherein said pedal means has in the top view the shape of a preferably equal-sided trapezoid.

9. The safety ski binding according to claim 6, wherein the underside of said pedal means which slidably engages said stepping spur conforms to the form of the upper side of said stepping spur.

10. The safety ski binding according to claim 6, wherein said pedal means is U-shaped having a bight portion which is hingedly connected to said base plate about said second axis and having two legs which straddle said stepping spur, each said leg having a slot therein and including axles which extend outwardly in the direction of the ski edges from opposite sides of said stepping spur, each said axle being slidably received in a respective said slot.

* * * * *